US009595219B2

(12) United States Patent
Shim et al.

(10) Patent No.: US 9,595,219 B2
(45) Date of Patent: Mar. 14, 2017

(54) SCAN DRIVER AND DISPLAY DEVICE USING THE SAME

(71) Applicant: LG DISPLAY CO., LTD., Seoul (KR)

(72) Inventors: Dahye Shim, Seoul (KR); Joungmi Choi, Paju-si (KR); Hyunguk Jang, Seoul (KR)

(73) Assignee: LG DISPLAY CO., LTD, Seoul (KR)

( * ) Notice: Subject to any disclaimer, the term of this patent is extended or adjusted under 35 U.S.C. 154(b) by 0 days.

(21) Appl. No.: 14/733,271

(22) Filed: Jun. 8, 2015

(65) Prior Publication Data

US 2015/0364078 A1 Dec. 17, 2015

(30) Foreign Application Priority Data

Jun. 13, 2014 (KR) ..... 10-2014-0072184

(51) Int. Cl.
*G09G 3/20* (2006.01)

(52) U.S. Cl.
CPC ... *G09G 3/2092* (2013.01); *G09G 2310/0267* (2013.01); *G09G 2310/0286* (2013.01); *G09G 2310/0289* (2013.01); *G09G 2320/041* (2013.01); *G09G 2330/021* (2013.01)

(58) Field of Classification Search
CPC .. G09G 3/3233; G09G 3/2011; G09G 3/3291; G09G 2320/048; G09G 2300/0861; G09G 2320/0233; G09G 3/3677; G09G 2320/041; G09G 2310/0286; G09F 9/30; G09F 9/35
See application file for complete search history.

(56) References Cited

U.S. PATENT DOCUMENTS

2009/0237390 A1* 9/2009 Koyama ..... G09G 3/3233 345/212
2011/0058326 A1* 3/2011 Idems ..... G09F 9/30 361/679.21
2012/0098815 A1* 4/2012 Hou ..... G09G 3/3677 345/212

* cited by examiner

*Primary Examiner* — Larry Sternbane
*Assistant Examiner* — Robert Michaud
(74) *Attorney, Agent, or Firm* — Dentons US LLP

(57) ABSTRACT

A scan driver and display device using the same are disclosed. The display device includes display panel, a data driver configured to supply a data signal to the display panel, and a scan driver formed in a non-display area of the display panel, including a shift register composed of a plurality of stages and a level shifter formed outside the display panel, and configured to supply a scan signal to the display panel using the shift register and the level shifter. The scan driver comprises: a sensor circuit unit configured to sense internal and external environmental conditions and generate a compensation circuit control signal on the basis of a sensed result; and a compensation circuit unit generating a compensation signal to compensate outputs of the plurality of stages in response to the compensation circuit control signal.

16 Claims, 12 Drawing Sheets

$$\Delta V_T(t) = \left(\frac{Q_G}{Q_{G0}}\right) A (V_{GS} - V_{Ti}) t^{\beta}$$

SCAN DRIVER AND DISPLAY DEVICE USING THE SAME

This application claims the benefit of Korean Patent Application No. 10-2014-0072184, filed on Jun. 13, 2014, which is incorporated herein by reference for all purposes as if fully set forth herein.

BACKGROUND

Field of the Disclosure

Embodiments of the invention relate to a scan driver and a display device using the same.

Related Art

With the development of information technology, the market of display devices, which are interface media between users and information, is growing. Accordingly, display devices such as an organic light emitting display (OLED), a liquid crystal display (LCD) and a plasma display panel (PDP) are widely used.

From among the aforementioned display devices, the LCD or OLED, for example, include a display panel having a plurality of sub-pixels arranged in a matrix and a driver for driving the display panel. The driver includes a scan driver for supplying a scan signal (or gate signal) to the display panel, a data driver for supplying a data signal to the display panel, and the like.

Such display devices display an image according to light emission of selected sub-pixels upon supply of scan signals and data signals to the sub-pixels arranged in a matrix form.

The scan driver outputting scan signals is categorized into an external scan driver mounted in the form of an integrated circuit on an external substrate of the display panel and an embedded scan driver formed in the display panel in the form of a gate in panel (GIP) which is formed through a thin film transistor process. The embedded scan driver is composed of amorphous silicon or oxide thin film transistors.

However, in the case of a conventional embedded scan driver, it is difficult to secure reliability due to characteristic deterioration of elements (thin film transistors included in a circuit) when operation evaluation is performed in extreme environmental conditions. Accordingly, it is necessary to improve reliability of the embedded scan driver.

SUMMARY

An embodiment of the present invention provides a display device, including: a display panel; a data driver configured to supply a data signal to the display panel; and a scan driver formed in a non-display area of the display panel, including a shift register composed of a plurality of stages and a level shifter formed outside the display panel, and configured to supply a scan signal to the display panel using the shift register and the level shifter, wherein the scan driver comprises: a sensor circuit unit configured to sense internal and external environmental conditions and to generate a compensation circuit control signal on the basis of a sensed result; and a compensation circuit unit configured to generate a compensation signal for compensating outputs of the plurality of stages in response to the compensation circuit control signal.

Another embodiment of the present invention provides a scan driver, including: a level shifter; a shift register including a plurality of stages to generate a scan signal on the basis of a signal and power output from the level shifter; a sensor circuit unit configured to sense internal and external environmental conditions of the shift register and generate a compensation circuit control signal on the basis of a sensed result; and a compensation circuit unit generating a compensation signal to compensate outputs of the plurality of stages in response to the compensation circuit control signal.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION OF THE EMBODIMENTS

Reference will now be made in detail to embodiments of the invention, examples of which are illustrated in the accompanying drawings.

First Embodiment

Figure 1:
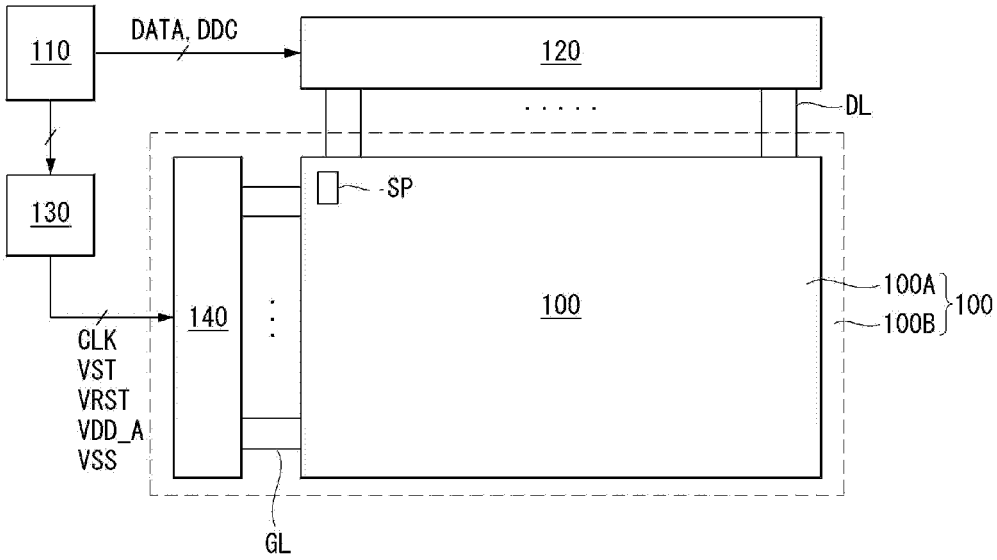
FIG. 1 is a block diagram of a display device.
Figure 2:
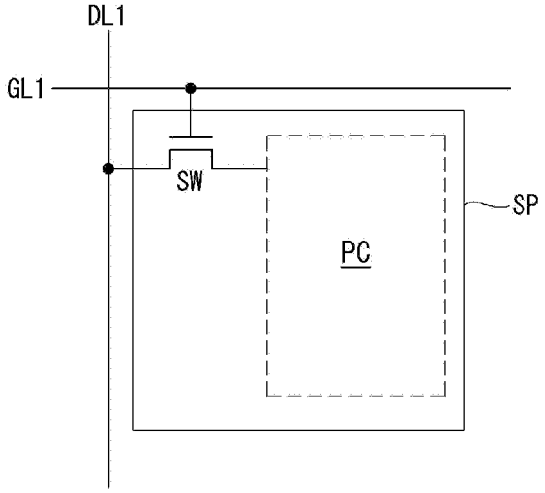
FIG. 2 illustrates a configuration of a sub-pixel shown in FIG. 1.

FIG. 1 a block diagram of a display device and FIG. 2 illustrates a configuration of a sub-pixel shown in FIG. 1.

As shown in FIG. 1, the display device includes a display panel 100, a timing controller 110, a data driver 120 and a scan driver 130 and 140.

The display panel 100 includes sub-pixels connected to data lines DL and scan lines GL crossing the data lines DL. The display panel 100 includes a display area 100A in which the sub-pixels are formed and a non-display area 100B outside the display area 100A, in which signal lines, pads and the like are formed. The display panel 100 may be implemented as an LCD, an OLED, an electrophoretic display (EPD) and the like.

Referring to FIG. 2, one sub-pixel SP includes a switching transistor SW connected to a scan line GL1 and a data line DL1 and a pixel circuit PC operating according to a data signal DATA supplied in response to a scan signal provided through the switching transistor W. The sub-pixels constitute an LCD panel including liquid crystal elements, an OLED panel including organic light-emitting elements or the like according to configuration of the pixel circuit PC.

When the display panel 100 is an LCD panel, the display panel 100 is implemented in a TN (Twisted Nematic) mode, VA (Vertical Alignment) mode, IPS (In Plane Switching) mode, FFS (Fringe Field Switching) mode or ECB (Electrically Controlled Birefringence) mode. When the display panel 100 is an OLED panel, the display panel 100 is implemented in a top-emission mode, bottom-emission mode or dual-emission mode.

The timing controller 110 receives timing signals such as a vertical synchronization signal, a horizontal synchronization signal, a data enable signal and a dot clock signal through an LVDS or TMDS interface circuit connected to a video board. The timing controller 110 generates timing control signals for controlling operation timing of the data driver 120 and the scan driver 130 and 140 on the basis of the timing signals input thereto.

The data driver 120 includes a plurality of source drive integrated circuits (ICs). The source drive ICs receive a data signal DATA and a source timing control signal DDC from the timing controller 110. The source drive ICs convert the data signal DATA from a digital signal into an analog signal in response to the source timing control signal DDC and supply the analog signal through the data lines DL of the display panel 100. The source drive ICs are connected to the data lines DL of the display panel 100 through a COG (Chip On Glass) or TAB (Tape Automated Bonding) process.

The scan drivers 130 and 140 include a level shifter 130 and a shift register 140. The scan drivers 130 and 140 are formed in a gate in panel (GIP) structure in which the level shifter 130 and the shift register 140 are separately formed.

The level shifter 130 is formed on an external substrate connected to the display panel 100 in the form of an IC. The level shifter 130 shifts levels of signals and power, supplied through a clock signal line CLK, a start signal line VST, a reset signal line VRST, a high-level power line VDD_A and a low-level power line VSS, under the control of the timing controller 11 and then provides the signals and power to the shift register 140.

The shift register 140 is formed in the non-display area 100B of the display panel 100 in the form of thin film transistors in a GIP structure. The shift register 140 is composed of stages that shift and output scan signals in response to a signal and power supplied from the level shifter 130. The stages included in the shift register 140 sequentially output scan signals through output terminals.

In the aforementioned embedded scan driver formed in such a manner that the level shifter 130 and the shift register are separately formed, the shift register 140 is implemented by oxide or amorphous silicon thin film transistors and the like. The oxide thin film transistor has excellent current transfer characteristics and thus a circuit size can be reduced compared to the amorphous silicon thin film transistor. The amorphous silicon thin film transistor has excellent threshold voltage recovery characteristics according to stress bias, compared to the oxide thin film transistor, since the threshold voltage thereof can be kept uniform.

However, the embedded scan driver has a problem that it is difficult to secure reliability due to characteristic deterioration of elements (thin film transistors included in the circuit) when driving evaluation is performed in extreme environmental conditions (high temperature of 90° C. or higher/low temperatures of 30° C. or higher, 1000 hours or longer). Accordingly, in a first embodiment of the present invention, a circuit capable of securing reliability of the embedded scan driver in extreme environmental conditions is implemented as described below.

A description will be given of an embedded scan driver capable of securing reliability in extreme environmental conditions.

Figure 3:
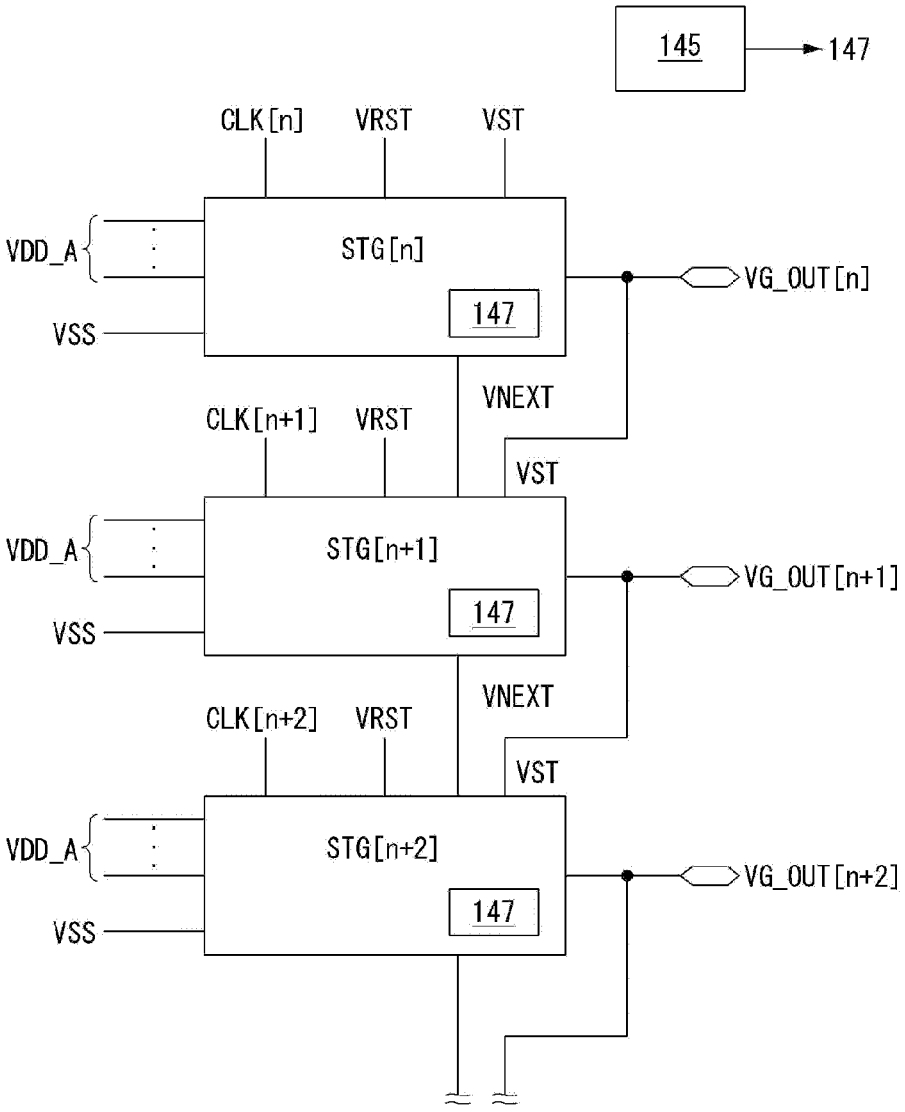
FIG. 3 illustrates a configuration of a stage of an embedded scan driver according a first embodiment of the present invention.
Figure 4:
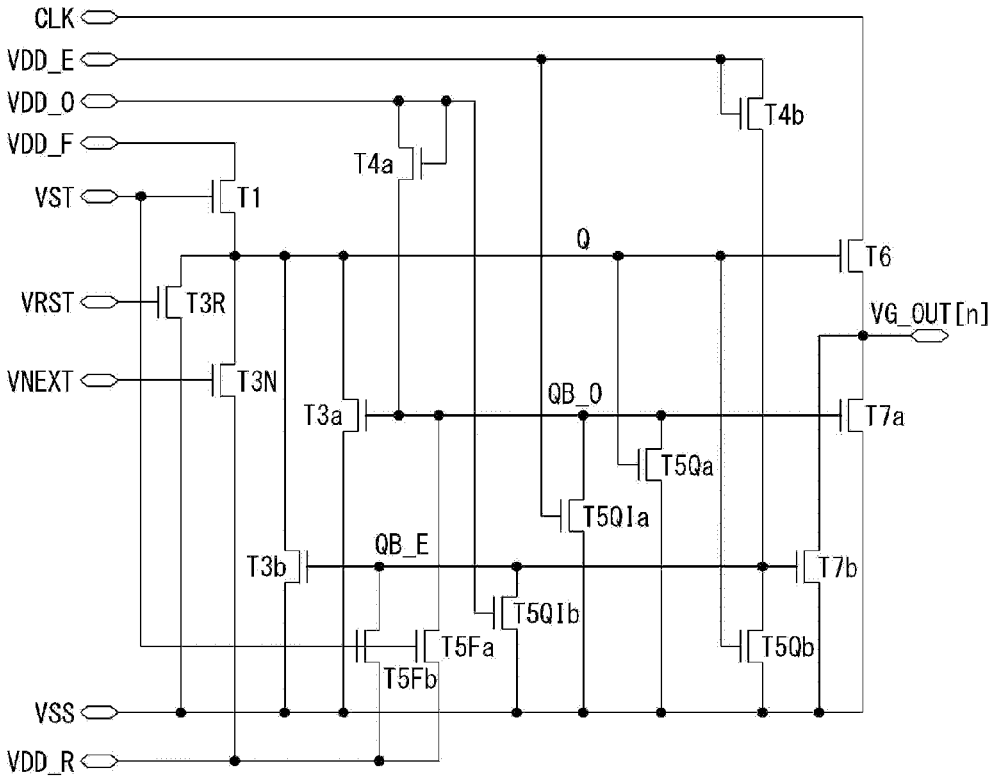
FIG. 4 illustrates an exemplary circuit configuration of an N-th stage of an embedded scan driver according to a first comparative example.
Figure 5:
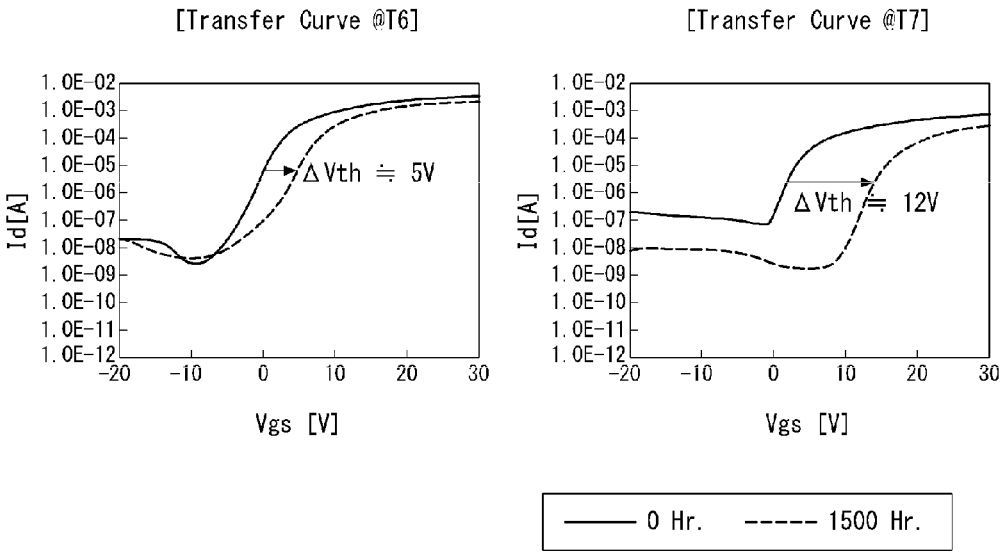
FIG. 5 is a graph showing threshold voltage shift when the circuit shown in FIG. 4 is tested in an extreme environmental conditions.
Figure 5:
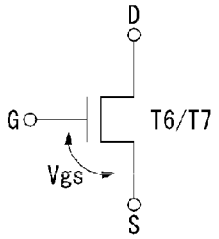
Figure 6:
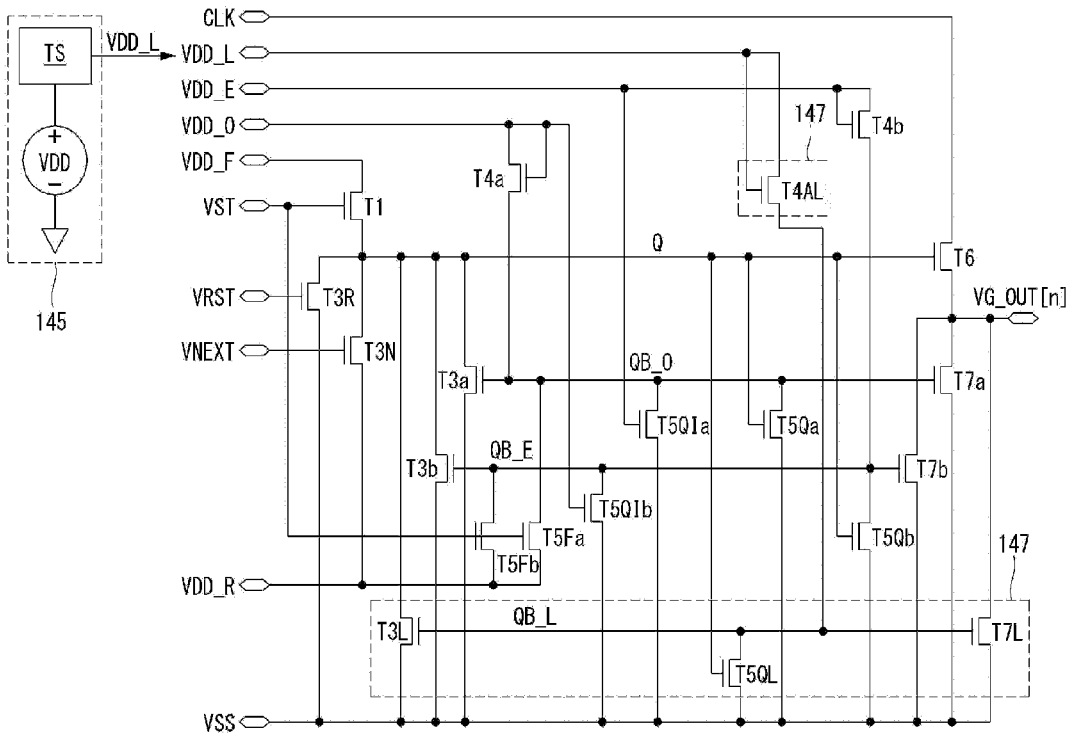
FIG. 6 illustrates an exemplary circuit configuration of an N-th stage of an embedded scan driver according to a first embodiment.
Figure 7:
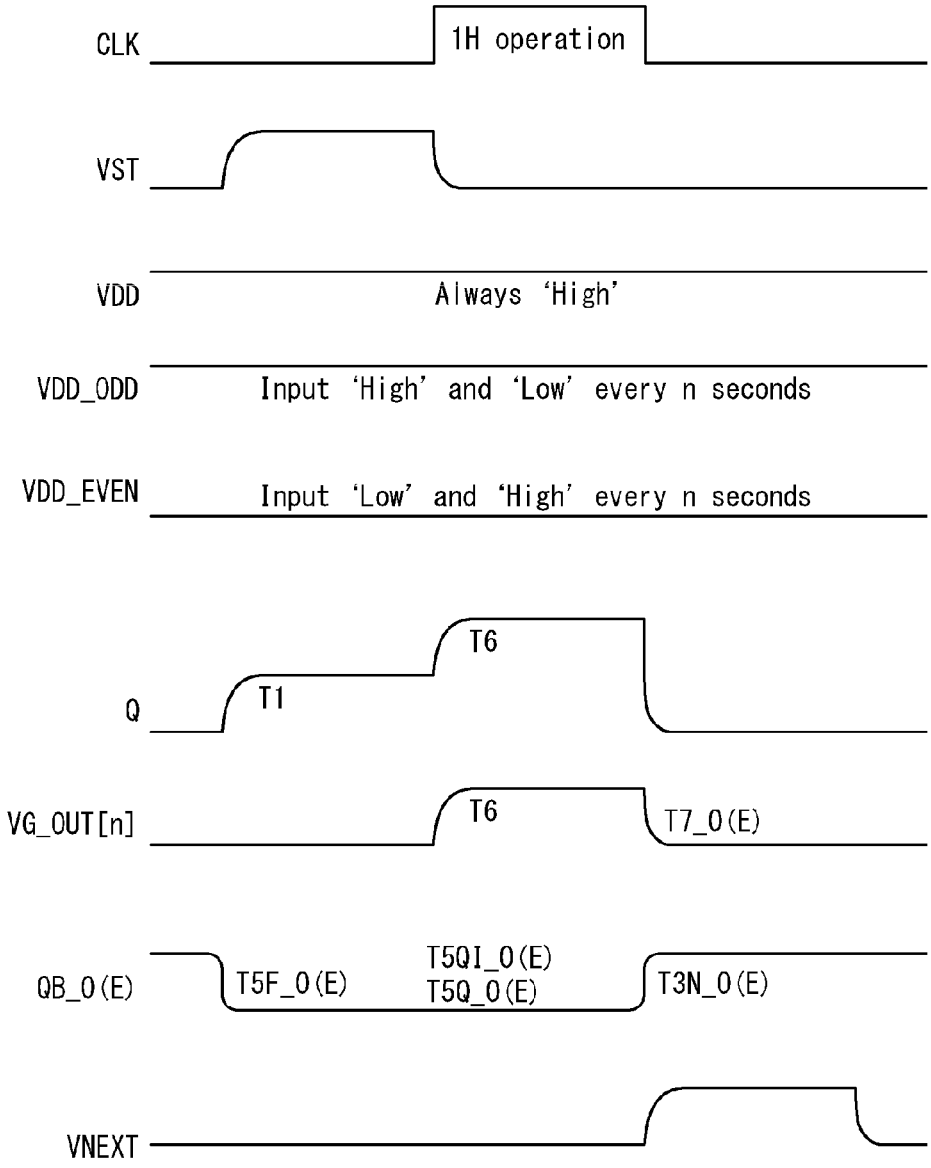
FIG. 7 illustrates driving waveforms of the circuit shown in FIG. 6.

FIG. 3 illustrates a configuration of a stage of an embedded scan driver according the first embodiment of the present invention, FIG. 4 is a circuit diagram of an N-th stage of an embedded scan driver according to a first comparative example, and FIG. 5 is a graph showing threshold voltage shift when the circuit shown in FIG. 4 is tested in an extreme environmental condition. FIG. 6 is a circuit diagram of an N-th state of the embedded scan driver according to the first embodiment and FIG. 7 illustrates driving waveforms of the circuit shown in FIG. 6.

As shown in FIG. 3, the embedded scan driver according to the first embodiment of the present invention includes a plurality of stages STG[n] to STG[n+2], which constitute a shift register, and a sensor circuit unit 145. The plurality of stages STG[n] to STG[n+2] include a compensation circuit unit 147 operating in connection with the sensor circuit unit 145.

The stages STG[n] to STG[n+2] operate to output scan signals in response to signals and power supplied through clock signal lines CLK[n] to CLK[n+2], reset signal lines VRST, a start signal line VST, high-level power lines VDD_A and one or more low-level power lines VSS.

The clock signal lines CLK[n] to CLK[n+2] are configured to transmit clock signals having different phases, such as 3 phases, 4 phases and 6 phases. The reset signal lines VRST are configured to transmit one global reset signal or reset signals having different phases, such as 2 phases, 4 phases and 6 phases, in response to a clock signal. The high-level power lines VDD_A are configured to transmit a voltage alternating between logic high and logic low every n seconds (n being an integer equal to or larger than 1), a voltage maintained as logic high all the time, a voltage changed to logic high or logic low at a specific state, and the like. The one or more low-level power lines VSS are configured to transmit a voltage corresponding to ground voltage or a negative voltage lower than the ground voltage.

The N-th stage STG[n] operates in response to signals and power supplied through the N-th clock signal line CLK[n], the reset signal line VRST, the start signal line VST, the high-level power line VDD_A and the low-level power line VSS. The N-th stage STG[n] outputs the N-th scan signal through an output terminal VG_OUT[n] thereof.

The (N+1)-th stage STG[n+1] operates in response to signals and power supplied through the (N+1)-th clock signal line CLK[n+1], the reset signal line VRST, the high-level power line VDD_A and the low-level power line VSS. The (N+1)-th stage STG[n+1] outputs the (N+1)-th scan signal through an output terminal VG_OUT[n+1] thereof.

The (N+2)-th stage STG[n+2] operates in response to signals and power supplied through the (N+2)-th clock signal line CLK[n+2], the reset signal line VRST, the high-level power line VDD_A and the low-level power line VSS. The (N+2)-th stage STG[n+2] outputs the (N+2)-th scan signal through an output terminal VG_OUT[n+2] thereof.

Output terminals and input terminals of the stages STG[n] to STG[n+2] are connected such that the stages STG[n] to STG[n+2] operate on the basis of scan signals output through the output terminals of previous stages or following stages. For example, the (N+1)-th stage STG[n+1] can be connected to the output terminal VG_OUT[n] of the N-th stage STG[n] in order to use the N-th scan signal as a start signal applied to the input terminal thereof. The (N+2)-th stage STG[n+2] can be connected to the output terminal VG_OUT[n+1] of the (N+1)-th stage STG[n+1] in order to use the (N+1)-th scan signal as a start signal applied to the input terminal thereof.

In addition, the output terminals and input terminals of the stages STG[n] to STG[n+2] are connected such that the stages STG[n] to STG[n+2] operate on the basis of scan signals output through the output terminal of the following stage (e.g. VG_OUT[n+1]) or the output terminal (e.g. VG_OUT[n+2]) of the stage after the following stage. For example, the N-th stage STG[n] can be connected to the output terminal VG_OUT[n+1] of the (N+1)-th stage STG [n+1] in order to use the (N+1)-th scan signal as a stabilization signal (or reset signal) of the input terminal thereof. In addition, the N-th stage STG[n] can be connected to the output terminal VG_OUT[n+2] of the (N+2)-th stage STG [n+2] in order to use the (N+2)-th scan signal as a stabilization signal (or reset signal) of the input terminal thereof.

The embedded scan driver according to the first embodiment of the present invention includes the sensor circuit unit 145 and the compensation circuit unit 147 operating in connection with the sensor circuit unit 145 to secure reliability in extreme environmental conditions.

The compensation circuit unit 147 is included in the plurality of stages STG[n] to STG[n+2]. The compensation circuit unit 147 is composed of transistors. That is, the compensation circuit unit 147 is configured in the same GIP structure as the stages STG[n] to STG[n+2] and includes in the stages. The sensor circuit unit 145 is separately configured outside the stages (e.g. external substrate on which the level shifter 130 is mounted). That is, the sensor circuit unit 145 is composed of an IC or the like and provided to the outside of the stages.

The circuits added to secure reliability will be described in detail through comparison of circuit configurations of the N-th stage between a first comparative example and the first embodiment.

First Comparative Example

As shown in FIG. 4, the N-th stage of the embedded scan driver according to the first comparative example includes a scan direction controller T1, T3N, a node controller T3R, T3*a*, T4Aa, T5Fa, T5QIa, T5Qa, T3*b*, T4Ab, T5Fb, T5QIb, T5Qb, and an output controller T6, T7*a*, T7*b*. The circuit configuration of the N-th stage will now be described.

The scan direction controller T1, T3N sets a shift direction of the scan signal of the N-th stage to forward or reverse direction. The node controller T3R, T3*a*, T4Aa, T5Fa, T5QIa, T5Qa, T3*b*, T4Ab, T5Fb, T5QIb, T5Qb charges or discharges a Q node Q, an odd-numbered QB node QB_O and an even-numbered QB node QB_E of the N-th stage. The output controller T6, T7*a*, T7*b* outputs a scan signal at a scan high voltage or a scan signal at a scan low voltage through the output terminal VG_OUT[n] of the N-th stage.

In the embedded scan driver implemented as the aforementioned circuit, transistors T3*a*, T3*b*, T7*a* and T7*b* maintain charged state during 1 frame, except a time when the Q node Q is charged (or turned on), to control the output of the output terminal VG_OUT[n] of the N-th stage to be a low-level voltage. Accordingly, the transistors T3*a*, T3*b*, T7*a* and T7*b* to which a high bias voltage is applied continuously for a long time maintain an operating state, and thus characteristics thereof are deteriorated.

In the meantime, transistor characteristics depend on bias voltage, stress time, operation environment (temperature and the like). For example, third and seventh transistors T3 and T7 (corresponding to T3*a*, T3*b*, T7*a* and T7*b*) which maintain a charged state for a long time have a large threshold voltage (Vth) shift due to bias temperature stress (BTS), compared to other transistors. FIG. 5 shows threshold voltage shift that occurs when the embedded scan driver of the first comparative example is operated at 60° C. for 1500 hours.

When the embedded scan driver of the first comparative example is operated in an extreme environmental condition (at a high temperature of 90° C. or higher/low temperature of −30° C. or lower, 1000 hours), threshold voltage shift occurs due to transistor deterioration according to operation at a high-temperature for a long time because of the aforementioned characteristics. When the third transistor T3 (T3*a* and T3*b*) is not correctly operated due to the threshold voltage shift, the Q node Q is floated and multiple signals are generated according to a clock signal. That is, the sixth transistor T6 is not correctly charged, and thus unwanted multiple outputs are generated at the output terminal VG_OUT[n] of the N-th stage.

First Embodiment

As shown in FIG. 6, the N-stage of the embedded scan driver according to the first embodiment includes a scan direction controller T1, T3N, a node controller T3R, T3*a*, T4Aa, T5Fa, T5QIa, T5Qa, T3*b*, T4Ab, T5Fb, T5QIb, T5Qb, an output controller T6, T7*a*, T7*b*, and a compensation circuit unit T3L, T4AL, T5QL, T7L. The circuit configuration of the N-th stage will now be briefly described.

The scan direction controller T1, T3N sets a shift direction of the scan signal of the N-th stage to forward or reverse direction. The node controller T3R, T3*a*, T4Aa, T5Fa, T5QIa, T5Qa, T3*b*, T4Ab, T5Fb, T5QIb, T5Qb charges or discharges a Q node Q, an odd-numbered QB node QB_O and an even-numbered QB node QB_E of the N-th stage. The output controller T6, T7*a*, T7*b* outputs a scan signal at a scan high voltage or a scan signal at a scan low voltage through the output terminal VG_OUT[n] of the N-th stage. The compensation circuit unit T3L, T4AL, T5QL, T7L controls a compensation QB node QB_L when the embedded scan driver is under an extreme environmental condition to compensate for output of the output terminal VG_OUT[n] of the N-th stage.

The scan direction controller includes a first transistor T1 and a third transistor T3N. The first transistor T1 has a gate electrode connected to a first input terminal VST, a first electrode connected to a first high-level power line VDD_F through which a forward voltage is supplied, and a second electrode connected to the Q node Q. The first transistor T1 charges or discharges the Q node Q in response to a signal supplied through the first input terminal VST and the forward voltage supplied through the first high-level power line VDD_F. When the first transistor T1 is turned on, the shift direction of the scan signal of the N-th stage is set to the forward direction.

The third transistor T3N has a gate electrode connected to a second input terminal VNEXT, a first electrode connected to a second high-level power line VDD_R through which a reverse voltage is supplied, and a second electrode connected to the Q node Q. The third transistor T3N discharges or charges the Q node Q in response to a signal supplied through the second input terminal VNEXT and the reverse voltage supplied through the second high-level power line VDD_R. When the third transistor T3N is turned on, the shift direction of the scan signal of the N-th stage is set to the reverse direction.

The node controller includes transistors T3R, T3*a*, T4Aa, T5Fa, T5QIa, T5Qa, T3*b*, T4Ab, T5Fb, T5QIb and T5Qb. The transistors T3R, T3*a* and T3*b* control the Q node Q, the transistors T4Aa, T5Fa, T5QIa and T5Qa control the odd-numbered QB node QB_O, and the transistors T4Ab, T5Fb, T5QIb and T5Qb control the even-numbered QB node QB_E.

The third transistor T3R has a gate electrode connected to a third input terminal VRST, a first electrode connected to the low-level power line VSS and a second electrode connected to the Q node Q. The third transistor T3R discharges the Q node Q in response to a reset signal supplied through the third input terminal VRST. When the third transistor T3R is turned on, the Q node Q is discharged (or reset) to a voltage corresponding to the ground voltage or a negative voltage lower than the ground voltage.

The transistor T3*a* has a gate electrode connected to the odd-numbered QB node QB_O, a first electrode connected to the low-level power line VSS and a second electrode connected to the Q node Q. When the transistor T3*a* is turned on, the Q node Q is discharged to a voltage corresponding to the ground voltage or a negative voltage lower than the ground voltage.

The transistor T4Aa has a gate electrode and a first electrode, which are connected to a third high-level power line VDD_O, and a second electrode connected to the odd-numbered QB node QB_O. When the transistor T4Aa is turned on, the odd-numbered QB node QB_O is charged to a third high-level voltage or discharged.

The transistor T5Fa has a gate electrode connected to the first input terminal VST, a first electrode connected to a second high-level power line VDD_R and a second electrode connected to the odd-numbered QB node QB_O. When the transistor T5Fa is turned on, the odd-numbered QB node QB_O is charged to a second high-level voltage or discharged.

The transistor T5QIa has a gate electrode connected to a fourth high-level power line VDD_E, a first electrode connected to the low-level power line VSS and a second electrode connected to the odd-numbered QB node QB_O. When the transistor T5QIa is turned on, the odd-numbered QB node QB_O is discharged to the low-level voltage.

The transistor T5Qa has a gate electrode connected to the Q node Q, a first electrode connected to the low-level power line VSS and a second electrode connected to the even-numbered QB node QB_O. When the transistor T5Qa is turned on, the odd-numbered QB node QB_O is discharged to the low-level voltage.

The transistor T3*b* has a gate electrode connected to the even-numbered QB node QB_E, a first electrode connected to the low-level power line VSS and a second electrode connected to the Q node Q. When the transistor T3*b* is turned on, the Q node Q is discharged to a voltage corresponding to the ground voltage or a negative voltage lower than the ground voltage.

The transistor T4Ab has a gate electrode and a first electrode, which are connected to the fourth high-level power line VDD_E, and a second electrode connected to the even-numbered QB node QB_E. When the transistor T4Ab is turned on, the even-numbered QB node QB_E is charged to the fourth high-level voltage or discharged.

The transistor T5Fb has a gate electrode connected to the first input terminal VST, a first electrode connected to the second high-level power line VDD_R and a second electrode connected to the even-numbered QB node QB_E. When the transistor T5Fb is turned on, the even-numbered QB node QB_E is charged to the second high-level voltage or discharged.

The transistor T5QIb has a gate electrode connected to the third high-level power line VDD_O, a first electrode connected to the low-level power line VSS and a second electrode connected to the even-numbered QB node QB_E. When the transistor T5QIb is turned on, the even-numbered QB node QB_E is discharged to the low level power.

The transistor T5Qb has a gate electrode connected to the Q node Q, a first electrode connected to the low-level power line VSS and a second electrode connected to the even-numbered QB node QB_E. When the transistor T5Qb is turned on, the even-numbered QB node QB_E is discharged to the low-level voltage.

The output controller includes a sixth transistor T6 serving as a pull-up transistor, and transistors T7*a* and T7*b* serving as pull-down transistors. The sixth transistor T6 outputs a scan signal at a scan high voltage and the transistors T7*a* and T7*b* output a scan signal at a scan low voltage.

The sixth transistor T6 has a gate electrode connected to the Q node Q, a first electrode connected to the clock signal line CLK and a second electrode connected to the output terminal VG_OUT[n]. When the Q node Q is charged, the sixth transistor outputs a signal supplied through the clock signal line CLK as a scan signal.

The transistor T7*a* has a gate electrode connected to the odd-numbered QB node QB_O, a first electrode connected to the low-level power line VSS and a second electrode connected to the output terminal VG_OUT[n]. When the odd-numbered QB node QB_O is charged, the transistor T7*a* outputs a voltage supplied through the low-level power line VSS as a scan signal.

The transistor T7*b* has a gate electrode connected to the even-numbered QB node QB_E, a first electrode connected to the low-level power line VSS and a second electrode connected to the output terminal VG_OUT[n]. When the even-numbered QB node QB_E is charged, the transistor T7*b* outputs a voltage supplied through the low-level power line VSS as a scan signal.

The N-th stage of the embedded scan driver according to the first embodiment can operate in response to a clock signal CLK, a start signal VST, a high-level voltage VDD, a third high-level voltage VDD_ODD, a fourth high-level voltage VDD_EVEN and a next stage signal VNEXT, as shown in FIG. 7. However, the present invention is not limited thereto.

Specifically, the clock signal CLK is supplied as a clock signal for 1 horizontal operation. The high-level voltage VDD is kept in logic high state. The third high-level voltage VDD_ODD alternates between logic high and logic low every n seconds (n being an integer equal to or larger than 2). The fourth high-level voltage VDD_EVEN alternates between logic low and logic high every n seconds (n being an integer equal to or larger than 2). That is, the odd-numbered QB node QB_ODD and the even-numbered QB node QB_EVEN alternately operate by the third high-level voltage VDD_ODD and the fourth high-level voltage VDD_EVEN.

The voltage of the Q node Q of the N-th stage is bootstrapped by the first and sixth transistors T1 and T6. The scan signal output from the output terminal VG_OUT[n] of the N-th stage is output as a logic high signal according to the sixth transistor T6 for a 1H period and then kept at a logic low level according to the transistor Ta or Tb (T7O (E)).

The voltage charged state of the odd-numbered or even-numbered QB node QB_O(E) is defined by the transistors T5Fa, T5Fb, T5QIa, T5QIb, T5Qa, T5Qb and T3N. The next stage signal VNEXT maintains logic high for a 1H period after at least 1H period from the clock signal CLK.

The compensation circuit unit T3L, T4AL, T5QL, T7L controls a compensation QB node QB_L to compensate for output of the output terminal VG_OUT[n] through operation in connection with the sensor circuit unit 145 when the embedded scan driver is under an extreme environmental condition.

According to the first embodiment of the present invention, the sensor circuit unit 145 is composed of a temperature sensor TS independently driven by a separate power supply VDD. The temperature sensor TS senses whether the embedded scan driver is in an extreme environmental condition. Here, the temperature sensor TS outputs a compensation circuit control signal through an output terminal thereof when the embedded scan driver (particularly, the shift register) is exposed to a temperature higher than −30° C. Then, the compensation circuit unit T3L, T4AL, T5QL, T7L outputs a compensation signal for compensating for the output of the output terminal VG_OUT[n] of the N-th stage in response to the compensation circuit control signal.

The compensation circuit unit T3L, T4AL, T5QL, T7L corresponds to the circuit that controls the odd-numbered QB node QB_O or the even-numbered QB node QB_E or is composed of a number of transistors one less than the number of transistors constituting the circuit. The compensation circuit unit T3L, T4AL, T5QL, T7L operates in connection with the sensor circuit unit 145 such that the compensation circuit unit operates under the control of the sensor circuit unit 145. For example, the compensation circuit unit includes transistors T3L, T4AL, T5QL and T7L. Here, when the compensation circuit unit is composed of transistors one less than the number of transistors constituting the circuit for controlling the odd-numbered QB node QB_O or the even-numbered QB node QB_E, circuit complexity can be reduced. However, when the compensation circuit unit is implemented to correspond to the circuit for controlling the odd-numbered QB node QB_O or the even-numbered QB node QB_E, the circuit can be stably operated and thus operation reliability can be improved. A description will be given of the transistors T3L, T4AL, T5QL and T7L.

The transistor T3L has a gate electrode connected to the compensation QB node QB_L, a first electrode connected to the low-level power line VSS and a second electrode connected to the Q node Q. The transistor T3L discharges the Q node Q in response to charged or discharged state of the compensation QB node QB_L.

The transistor T4AL has a gate electrode and a first electrode, which are connected to a fifth input terminal VDD_L coupled to the output terminal of the sensor circuit unit 145, and a second electrode connected to the compensation QB node QB_L. The transistor T4AL charges or discharges the compensation QB node QB_L in response to a compensation circuit control signal supplied through the fifth input terminal VDD_L.

The transistor T5QL has a gate electrode connected to the Q node Q, a first electrode connected to the low-level power line VSS and a second electrode connected to the compensation QB node QB_L. The transistor T5QL discharges the compensation QB node QB_L in response to charged or discharged state of the Q node Q.

The transistor T7L has a gate electrode connected to the compensation QB node QB_L, a first electrode connected to the low-level power line VSS and a second electrode connected to the output terminal VG_OUT of the N-th stage. The transistor T7L serves as a compensation pull-down transistor.

When a compensation circuit control signal corresponding to logic high is output from the sensor circuit unit 145, the compensation QB node QB_L is charged and the transistor T7L outputs a compensation signal for compensating for the output of the output terminal VG_OUT[n] of the N-th stage. The charged compensation QB node QB_L means that the embedded scan driver is in an extreme environmental condition and thus compensation operation is performed.

When a compensation circuit control signal corresponding to logic low is output from the sensor circuit unit 145, the compensation QB node QB_L is discharged and the transistor T7L does not output a compensation signal for compensating for the output of the output terminal VG_OUT[n] of the N-th stage. The discharged compensation QB node QB_L means that the embedded scan driver is not in an extreme environmental condition and thus compensation operation is not performed.

As described above, when the embedded scan driver is in an extreme environmental condition, the first embodiment of the present invention can compensate for operation of the embedded scan driver so as to overcome problems caused by transistor characteristic deterioration.

According to test results, a first comparative example (a) implemented by the circuit of FIG. 4 is difficult to maintain low-level voltage output through the output terminal thereof due to transistor characteristic deterioration in the shift register owing to on current decrease during operation at a low temperature (e.g., −40° C.)

Conversely, the first embodiment (b) implemented by the circuit of FIG. 6 can maintain the low-level voltage output through the output terminal thereof since transistor characteristic deterioration in the shift register due to on current decrease is compensated by the compensation circuit during operation at a low temperature (e.g., −40° C.), The low-level power can be maintained even in a specific environmental condition in the present invention because the number of operations of the compensation circuit or operation time of the compensation circuit is less than that of the conventional circuit (conventional node). That is, while the conventional circuit continues the operation for a long time, the compensation circuit temporarily performs the aforementioned operation thereof (the compensation QB node QB_L performs operation replacing the operation of the odd-numbered or even-numbered QB node) only in a specific environmental condition and thus characteristic deterioration can be overcome.

Accordingly, unwanted multiple outputs are generated at the output terminal VG_OUT[n] of the N-th stage in the first comparative example (a), whereas unwanted multiple outputs are not generated at the output terminal VG_OUT[n] of the N-th stage in the first embodiment (b), as can be known through comparison of waveforms.

While the sensor circuit unit 145 includes the temperature sensor TS in the above description, a current sensor or a voltage sensor may be used for the sensor circuit unit 145. When the current sensor or voltage sensor is used, current or voltage of a sensed part can be converted into data or an environment value similar to extreme environmental condition. Accordingly, a compensation signal in response to internal/external environmental variation may be output using the current or voltage sensor instead of the temperature sensor as necessary.

A description will be given of a modification in which the sensor circuit unit 145 includes the current sensor or the voltage sensor. Since first and second modifications described below are based on the shift register of the first embodiment, only added components are described in order to avoid redundant description.

Figure 8:
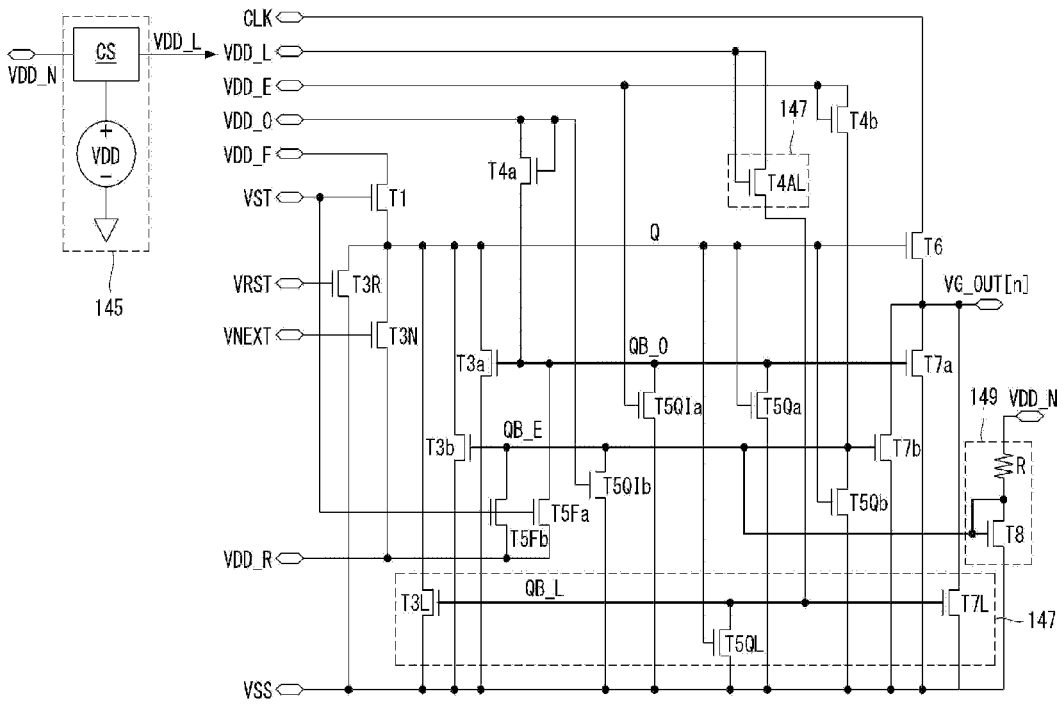
FIG. 8 illustrates an exemplary circuit configuration of an N-th stage of an embedded scan driver according to a first modification of the first embodiment.
Figure 9:
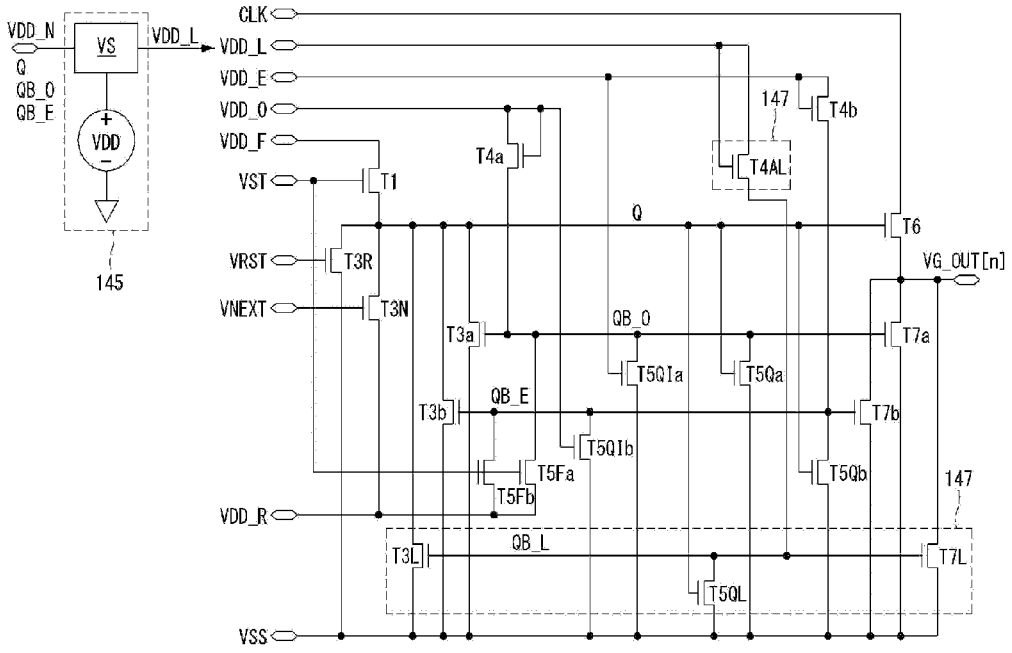
FIG. 9 illustrates an exemplary circuit configuration of an N-th stage of an embedded scan driver according to a second modification of the first embodiment.

FIG. 8 illustrates an exemplary circuit configuration of an N-th stage of an embedded scan driver according to the first modification of the first embodiment and FIG. 9 illustrates an exemplary circuit configuration of an N-th stage of an embedded scan driver according to the second modification of the first embodiment.

Example of Using a Current Sensor

As shown in FIG. 8, the embedded scan driver according to the first modification includes the sensor circuit unit 145, the N-th stage constituting the shift register, the compensation circuit unit 147 and a current detector 149 included in the N-th stage.

In the embedded scan driver according to the first modification, the sensor circuit unit 145 includes a current sensor CS. In this case, the N-th stage further includes the current detector 149. The current detector 149 may be implemented as a current mirror.

When the current detector 149 is included in all stages, the environmental conditions of all stages can be referred to. In this case, however, costs for the current detector 149 may increase manufacturing costs. Accordingly, it is desirable that the current detector 149 be included only in at least one dummy stage.

The current detector 149 may be configured to sense current of the even-numbered QB node QB_E and to feed back the sensed current thereto. In addition, the current detector 149 may be configured to sense current of the odd-numbered QB node QB_O or the even-numbered QB node QB_E and to feed back the sensed current thereto.

For example, the current detector 149 can include an eighth transistor T8 having a gate electrode connected to the even-numbered QB node QB_E, a first electrode connected to the low-level power line VSS and a second electrode connected to an input terminal VDD_N of the current detector 149. A resistor R may be connected between the second electrode of the eighth transistor T8 and the input terminal VDD_N of the current detector 149. Here, the resistor R refers to line resistance or is used to protect the current detector 149 corresponding to a control circuit.

While the current detector 149 is provided to the inside of the stage in order to aid in understating of description in the embodiment, the current detector 149 may be included in the current sensor 145.

Example of Using a Voltage Sensor

As shown in FIG. 9, the embedded scan driver according to the second modification includes the sensor circuit unit 145, the N-th stage constituting the shift register and the compensation circuit unit 147 included in the N-th stage.

In the embedded scan driver according to the second modification, the sensor circuit unit 145 includes a voltage sensor VS. In this case, the voltage sensor VS is configured to sense the voltage of the Q node Q, the odd-numbered QB node QB_O or the even-numbered QB node QB_E of the N-th stage. The sensor circuit unit 145 may be configured to sense all voltages of the Q node Q, the odd-numbered QB node QB_O or the even-numbered QB node QB_E of the N-th stage.

The embedded scan driver configured such that the odd-numbered QB node QB_O and the even-numbered QB node QB_E alternately operate has been described. However, the embedded scan driver can be configured in various manners and the present invention can be appropriately applied thereto and thus embodiments and description thereof are added in order to aid in understanding of the present invention.

Second Embodiment

Figure 10:
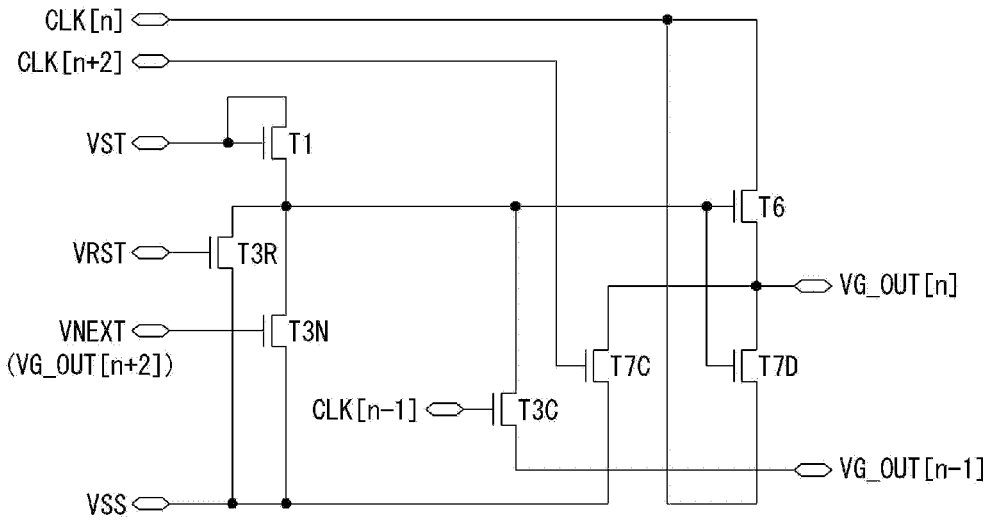
FIG. 10 illustrates an exemplary circuit configuration of an N-th stage of an embedded scan driver according to a second comparative example.
Figure 11:
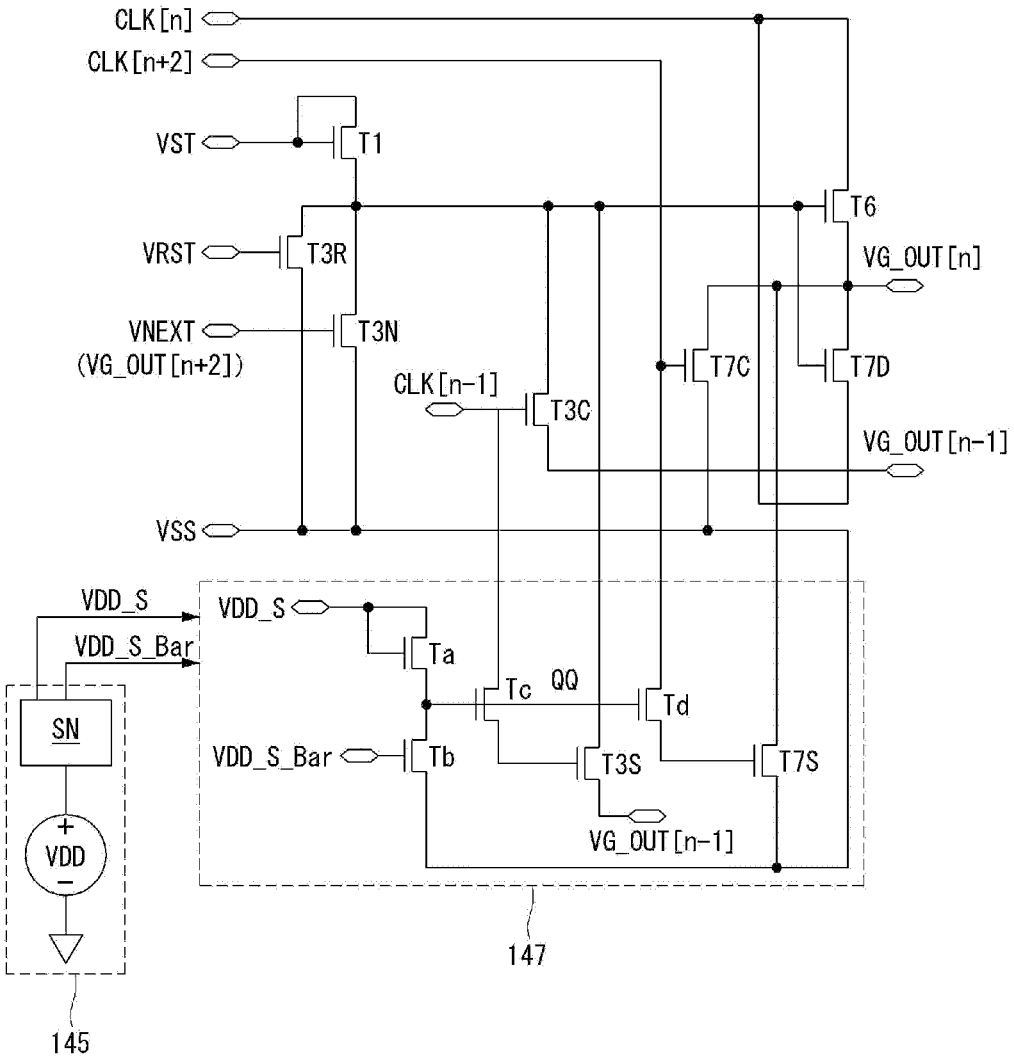
FIG. 11 illustrates an exemplary circuit configuration of an N-th stage of an embedded scan driver according to a second embodiment.

FIG. 10 illustrates an exemplary circuit configuration of an N-th stage of an embedded scan driver according to a second comparative example and FIG. 11 illustrates an exemplary circuit configuration of an N-th stage of an embedded scan driver according to a second embodiment.

Second Comparative Example

As shown in FIG. 10, the N-th stage of the embedded scan driver according to the second comparative example includes a Q node charging/discharging unit T1 and T3N, a Q node reset unit T3R, an output control unit T6, T7C and T7D, and a Q node stabilization unit T3C. The circuit included in the N-th stage will now be described.

The Q node charging/discharging unit T1 and T3N charges or discharges the Q node Q. The Q node reset unit T3R discharges the Q node Q. The output controller T6, T7C and T7D outputs a scan signal at a scan high voltage or a scan low voltage through the output terminal VG_OUT[n] of the N-th stage. The Q node stabilization unit T3C prevents voltage drop at the Q node Q.

In the embedded scan driver implemented by the aforementioned circuit, the transistors T3R, T7C and T7D are maintained in charged state for 1 frame, except a time when the Q node Q is charged (or turned on), so as to control the output of the output terminal VG_OUT[n] of the N-th stage to be a low-level voltage. Accordingly, the transistors T3R, T7C are T7D to which a high bias voltage is applied for a long time are kept in an operating state and thus characteristics thereof are deteriorated.

In the meantime, transistor characteristics depend on bias voltage, stress time, and operation environment (temperature and the like). Accordingly, the transistors T3R, T7C and T7D have a large Vth shift due to bias temperature stress (BTS), compared to other transistors.

When the embedded scan driver of the second comparative example is operated in an extreme environmental condition (for example, at a high temperature of 90° C. or higher/low temperature of −30° C. or lower, 1000 hours), threshold voltage shift occurs due to transistor deterioration according to operation at a high-temperature for a long time because of the aforementioned characteristics. Accordingly, the Q node Q is floated and multiple signals are generated according to a clock signal. That is, the sixth transistor T6 is not correctly charged, and thus unwanted multiple outputs are generated at the output terminal VG_OUT[n] of the N-th stage.

Second Embodiment

As shown in FIG. 11, the embedded scan driver according to the second embodiment includes the sensor circuit unit 145 and the compensation circuit unit 147 operating in connection with the sensor circuit unit 145 in order to secure reliability in extreme environmental conditions.

The sensor circuit unit 145 includes a sensor SN independently driven by a separate power supply VDD. The sensor SN senses whether the embedded scan driver is in an extreme environmental condition. Here, the sensor SN outputs a compensation circuit control signal through the output terminal thereof when the embedded scan driver is exposed to a temperature of higher than −30° C. approximately. Then, the compensation circuit unit 147 outputs a compensation signal for compensating for the output of the output terminal VG_OUT[n] of the N-th stage in response to the compensation circuit control signal.

The sensor SN included in the sensor circuit unit 145 may be a temperature sensor, a current sensor or a voltage sensor. When the current sensor or voltage sensor is used, current or voltage of a sensed part can be converted (approximated) into data or an environment value similar to extreme environmental condition. Accordingly, a compensation signal in response to internal/external environmental variation may be output using the current or voltage sensor instead of the temperature sensor as necessary.

A description will be given of an example in which the temperature sensor is used as the sensor SN. An example in which the current sensor or the voltage sensor is used as the sensor SN is described in the modifications of the first embodiment of the present invention and thus description thereof is omitted.

The compensation circuit unit 147 includes the N-th stage. The compensation circuit unit 147 is composed of transistors. That is, the compensation circuit unit 147 is configured in the same GIP structure as the stage and included in the stage. The sensor circuit unit 145 is separately configured outside the stage (on an external substrate on which the level shifter is mounted). That is, the sensor circuit unit 145 is configured in the form of an IC and provided outside the stage.

The N-th stage of the embedded scan driver according to the second embodiment includes a Q node charging/discharging unit T1 and T3N, a Q node reset unit T3R, an output control unit T6, T7C and T7D, a Q node stabilization unit T3C and a compensation circuit unit Ta, Tb, Tc, Td, T3S and T7S.

Since connection of the Q node charging/discharging unit T1 and T3N, the Q node reset unit T3R, the output control unit T6, T7C and T7D and the Q node stabilization unit T3C included in the N-th stage and functions thereof can be inferred through the first embodiment and FIG. 11, description thereof is omitted. The compensation circuit unit Ta, Tb, Tc, Td, T3S and T7S corresponding to the feature of the second embodiment will now be described.

The compensation circuit unit includes transistors Ta, Tb, Tc, Td, T3S and T7S.

The transistor Ta has a gate electrode and a first electrode, which are connected to a first output terminal VDD_S of the sensor circuit unit 145, and a second electrode connected to a compensation QQ node QQ. The transistor Ta charges the QQ node QQ in response to a first compensation circuit control signal output from the first output terminal VDD_S of the sensor circuit unit 145.

The transistor Tb has a gate electrode connected to a second output terminal VDD_S_Bar of the sensor circuit unit 145, a first electrode connected to the low-level power line VSS and a second electrode connected to the QQ node QQ. The transistor Tb discharges the QQ node QQ in response to a second compensation circuit control signal output from the second output terminal VDD_S_Bar of the sensor circuit unit 145.

The transistor Tc has a gate electrode connected to the compensation QQ node QQ, a first electrode connected to an (N−1)-th clock signal line CLK[n−1] and a second electrode connected to the gate electrode of a transistor T3S. The transistor Tc is turned on or turned off in response to the voltage of the compensation QQ node QQ and transfers an (N−1)-th clock signal supplied through the (N−1)-th clock signal line CLK[n−1] to the gate electrode of the transistor T3S. That is, the transistor Tc turns on or turns off the transistor T3S.

The transistor Td has a gate electrode connected to the compensation QQ node QQ, a first electrode connected to an (N+2)-th clock signal line CLK[n+2] and a second electrode connected to the gate electrode of a transistor T7S. The transistor Td is turned on or turned off in response to the voltage of the compensation QQ node QQ and transfers an (N+2)-th clock signal supplied through the (N+2)-th clock signal line CLK[n+2] to the gate electrode of the transistor T7S. That is, the transistor Td turns on or turns off the transistor T7S.

The transistor T3S has a gate electrode connected to the second electrode of the transistor Tc, a first electrode connected to the output terminal VG_OUT[n−1] of the (N−1)-th stage and a second electrode connected to the Q node. The transistor T3S charges or discharges the Q node Q in response to the voltage of the output terminal VG_OUT[n−1] of the (N−1)-th stage.

The transistor T7S has a gate electrode connected to the second electrode of the transistor Td, a first electrode connected to the low-level power line VSS and a second electrode connected to the output terminal VG_OUT[n] of the N-th stage. The transistor T7S outputs a compensation signal for compensating for the output of the output terminal VG_OUT[n] of the N-th stage in response to the (N+2)-th clock signal. The transistor T7S serves as a compensation pull-down transistor.

When the first compensation circuit control signal corresponding to logic high is output from the first output terminal VDD_S of the sensor circuit unit 145, the compensation QQ node QQ is charged and the transistor T7S outputs the compensation signal for compensating for the output of the output terminal VG_OUT[n] of the N-th stage. The charged compensation QQ node QQ means that the embedded scan driver is in an extreme environmental condition and thus compensation operation needs to be performed.

When the second compensation circuit control signal corresponding to logic high is output from the second output terminal VDD_S_Bar of the sensor circuit unit 145, the compensation QQ node QQ is discharged and the transistor T7S does not output the compensation signal for compensating for the output of the output terminal VG_OUT[n] of the N-th stage. The discharged compensation QQ node QQ means that the embedded scan driver is not in an extreme environmental condition and thus compensation operation need not be performed.

The sensor circuit unit 145 includes two output terminals, that is, the first and second output terminals VDD_S and VDD_S_Bar in the above description. However, when the transistor Tb is a P-type transistor, the output terminals of the sensor circuit unit 145 can be integrated into one since two transistors can be selectively operated using a logic high or logic low signal.

Third Embodiment

Figure 12:
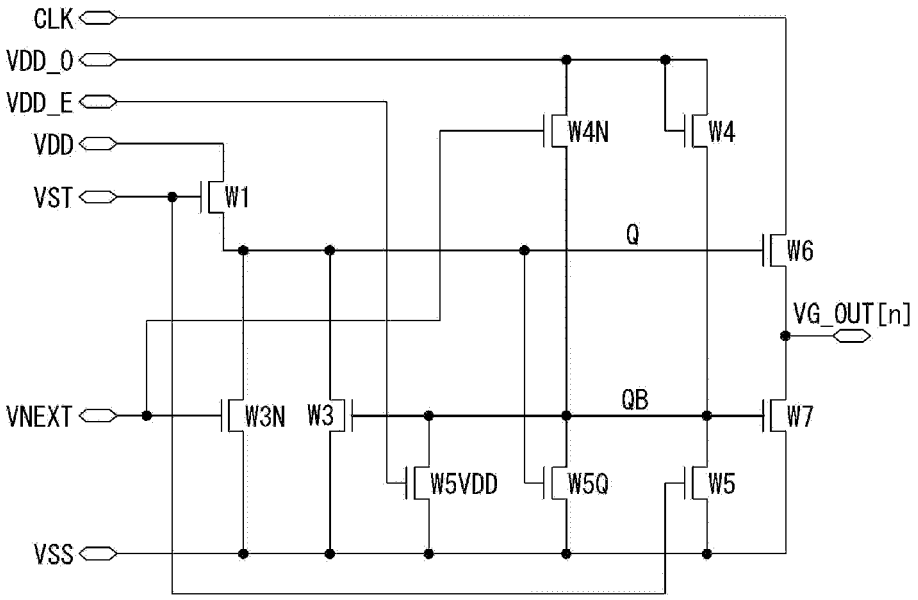
FIG. 12 illustrates an exemplary circuit configuration of an N-th stage of an embedded scan driver according to a third comparative example.
Figure 13:
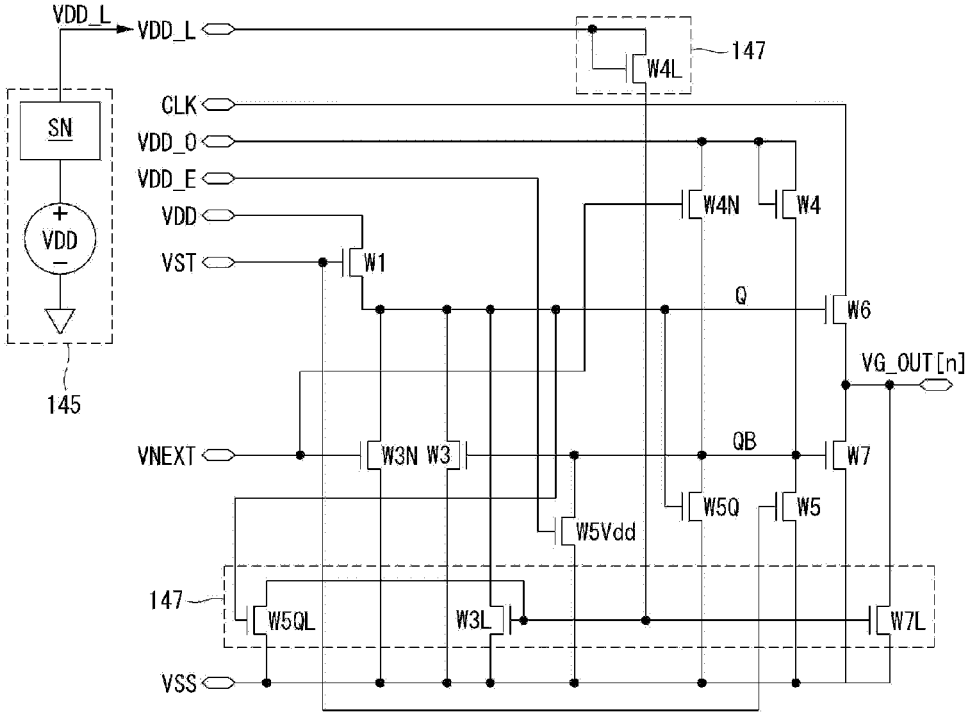
FIG. 13 illustrates an exemplary circuit configuration of an N-th stage of an embedded scan driver according to a third embodiment.

FIG. 12 illustrates an exemplary circuit configuration of an N-th stage of an embedded scan driver according to a third comparative example and FIG. 13 illustrates an exemplary circuit configuration of an N-th stage of an embedded scan driver according to a third embodiment.

Third Comparative Example

As shown in FIG. 12, the N-th stage of the embedded scan driver according to the third comparative example includes a Q node charging/discharging unit W1, W3 and W3N, a node controller W4N, W4, W5Vdd, W5Q and W5, and an output controller W6 and W7. The circuit included in the N-th stage will now be described.

The Q node charging/discharging unit W1, W3 and W3N charges or discharges the Q node Q. The node controller W4N, W4, W5Vdd, W5Q and W5 charges or discharges the Q node Q and the QB node QB of the N-th stage. The output controller W6 and W7 outputs a scan signal at a scan high voltage or a scan low voltage through the output terminal VG_OUT[n] of the N-th stage.

In the embedded scan driver implemented by the aforementioned circuit, the transistors W3N, W3 and W7 are maintained in charged state for 1 frame, except a time when the Q node Q is charged (or turned on), so as to control the output of the output terminal VG_OUT[n] of the N-th stage to be a low-level voltage. Accordingly, the transistors W3N, W3 and W7 to which a high bias voltage is applied for a long time are kept in an operating state and thus characteristics thereof are deteriorated.

In the meantime, transistor characteristics depend on bias voltage, stress time, and operation environment (temperature and the like). Accordingly, the transistors W3N, W3 and W7 have a large Vth shift due to bias temperature stress (BTS), compared to other transistors.

When the embedded scan driver of the third comparative example is operated in an extreme environmental condition (for example, at a high temperature of 90° C. or higher/low temperature of 30° C. or lower, 1000 hours), threshold voltage shift occurs due to transistor deterioration according to operation at a high-temperature for a long time because of the aforementioned characteristics. Accordingly, the Q node Q is floated and multiple signals are generated according to a clock signal. That is, the sixth transistor T6 is not correctly charged, and thus unwanted multiple outputs are generated at the output terminal VG_OUT[n] of the N-th stage.

Third Embodiment

As shown in FIG. 13, the embedded scan driver according to the third embodiment includes the sensor circuit unit 145 and the compensation circuit unit 147 operating in connection with the sensor circuit unit 145 in order to secure reliability in extreme environmental conditions.

The sensor circuit unit 145 includes a sensor SN independently driven by a separate power supply VDD. The sensor SN senses whether the embedded scan driver is in an extreme environmental condition. Here, the sensor SN outputs to a compensation circuit control signal through the output terminal thereof when the embedded scan driver is exposed to a temperature of higher than −30° C. approximately. Then, the compensation circuit unit 147 outputs a compensation signal for compensating for the output of the output terminal VG_OUT[n] of the N-th stage in response to the compensation circuit control signal.

The sensor SN included in the sensor circuit unit 145 may be a temperature sensor, a current sensor or a voltage sensor. When the current sensor or voltage sensor is used, current or voltage of a sensed part can be converted (approximated) into data or an environment value similar to extreme environmental condition. Accordingly, a compensation signal in response to internal/external environmental variation may be output using the current or voltage sensor instead of the temperature sensor as necessary.

A description will be given of an example in which the temperature sensor is used as the sensor SN. An example in which the current sensor or the voltage sensor is used as the sensor SN is described in the modifications of the first embodiment of the present invention and thus description thereof is omitted.

The compensation circuit unit 147 includes the N-th stage. The compensation circuit unit 147 is composed of transistors. That is, the compensation circuit unit 147 is configured in the same GIP structure as the stage and included in the stage. The sensor circuit unit 145 is separately configured outside the stage (on an external substrate on which the level shifter is mounted). That is, the sensor circuit unit 145 is configured in the form of an IC and provided outside the stage.

The N-th stage of the embedded scan driver according to the third embodiment includes a Q node charging/discharging unit W1, W3 and W3N), a node controller W4N, W4, W5Vdd, W5Q and W5, and an output controller W6 and W7. The circuit included in the N-th stage will now be described.

The Q node charging/discharging unit W1, W3 and W3N charges or discharges the Q node Q. The node controller W4N, W4, W5Vdd, W5Q and W5 charges or discharges the Q node Q and the QB node QB of the N-th stage. The output controller W6 and W7 outputs a scan signal at a scan high voltage or a scan low voltage through the output terminal VG_OUT[n] of the N-th stage.

Since connection of the Q node charging/discharging unit W1, W3 and W3N, the node controller W4N, W4, W5Vdd, W5Q and W5 and the output controller W6 and W7 included in the N-th stage and functions thereof can be inferred through the first embodiment and FIG. 13, description thereof is omitted. The compensation circuit unit W3L, W4L, W5QL and W7L corresponding to the feature of the third embodiment will now be described.

The compensation circuit unit includes transistors W3L, W4L, W5QL and W7L.

The transistor W4L has a gate electrode and a first electrode, which are connected to the output terminal VDD_L of the sensor circuit unit 145, and a second electrode connected to the compensation QQ node QQ. The transistor W4L charges or discharges the compensation QQ node QQ in response to a compensation circuit control signal output from the output terminal VDD_L of the sensor circuit unit 145.

The transistor W3L has a gate electrode connected to the compensation QQ node QQ, a first electrode connected to the low-level power line VSS and a second electrode connected to the Q node Q. The transistor W3L discharges the Q node Q in response to the voltage of the compensation QQ node QQ.

The transistor W5QL has a gate electrode connected to the Q node Q, a first electrode connected to the low-level power line VSS and a second electrode connected to the compensation QQ node QQ. The transistor W5QL discharges the compensation QQ node QQ in response to the voltage of the Q node Q.

The transistor W7L has a gate electrode connected to the compensation QQ node QQ, a first electrode connected to the low-level power line VSS and a second electrode connected to the output terminal VG_OUT[n] of the N-th stage. The transistor W7L outputs a compensation signal for compensating for the output of the output terminal VG_OUT[n] of the N-th stage in response to the voltage of the compensation QQ node QQ. The transistor W7L serves as a compensation pull-down transistor.

When a compensation circuit control signal corresponding to logic high is output from the output terminal VDD_L of the sensor circuit unit 145, the compensation QQ node QQ is charged and the transistor W7L outputs the compensation signal for compensating for the output of the output terminal VG_OUT[n] of the N-th stage. The charged compensation QQ node QQ means that the embedded scan driver is in an extreme environmental condition and thus compensation operation needs to be performed.

When a compensation circuit control signal corresponding to logic low is output from the output terminal VDD_L of the sensor circuit unit 145, the compensation QQ node QQ is discharged and the transistor W7L does not output the compensation signal for compensating for the output of the output terminal VG_OUT[n] of the N-th stage. The discharged compensation QQ node QQ means that the embedded scan driver is not in an extreme environmental condition and thus compensation operation need not be performed.

In the meantime, two electrodes of a transistor, other than the gate electrode, may be source and drain electrodes according to connection direction. Accordingly, the two electrodes serving as the source and drain electrodes are represented as the first electrode and the second electrode in the present invention.

As described above, the present invention provides a scan driver configured to secure reliability even in extreme environmental conditions, and a display device using the same. In addition, the present invention provides the scan driver capable of securing reliability even in variable internal/external environmental conditions, sensing node deterioration and outputting a compensation signal in response to the sensed node deterioration and the display device using the same.

What is claimed is:

1. A display device, comprising:

a display panel;

a data driver configured to supply a data signal to the display panel; and a scan driver formed in a non-display area of the display panel, including a shift register composed of a plurality of stages and a level shifter formed outside the display panel, and configured to supply a scan signal to the display panel using the shift register and the level shifter, wherein the scan driver comprises:

a sensor circuit unit configured to sense internal and external environmental conditions and to generate a compensation circuit control signal on the basis of a sensed result; and a compensation circuit unit configured to generate a compensation signal for compensating outputs of the plurality of stages in response to the compensation circuit control signal, wherein the compensation circuit unit comprises a first transistor having a gate electrode and a first electrode connected to a first output terminal of the sensor circuit unit, and a second electrode connected to a compensation node of the compensation circuit unit.

2. The display device of claim 1, wherein the sensor circuit unit includes one of a temperature sensor for sensing the internal and external environmental conditions, a current sensor for sensing current flowing through a Q node or a QB node of an N-th stage, and a voltage sensor for sensing a voltage of the Q node or the QB node of the N-th stage.

3. The display device of claim 1, wherein the compensation circuit unit is configured to stably output a scan signal at a scan high voltage and a scan signal at a scan low voltage through output terminals of the plurality of stages.

4. The display device of claim 1, wherein the compensation circuit unit is configured to correspond to circuits for controlling Q nodes or QB nodes of the plurality of stages or composed of a number of transistors less than the number of transistors constituting the circuits for controlling Q nodes or QB nodes.

5. The display device of claim 1, wherein the compensation circuit unit further comprises:

a second transistor having a gate electrode connected to the compensation node, a first electrode connected to a low-level power line through which a low-level voltage is provided, and a second electrode connected to the Q node of the N-th stage;

a third transistor having a gate electrode connected to the Q node of the N-th stage, a first electrode connected to the low-level power line, and a second electrode connected to the compensation node; and a fourth transistor having a gate electrode connected to the compensation node, a first electrode connected to the low-level power line, and a second electrode connected to an output terminal of the N-th stage.

6. The display device of claim 1, wherein the compensation circuit unit further comprises:

a second transistor having a gate electrode connected to a second output terminal of the sensor circuit unit, a first electrode connected to a low-level power line through which a low-level voltage is provided, and a second electrode connected to the compensation node;

a third transistor having a gate electrode connected to the compensation node and a first electrode connected to an (N−1)-th clock signal line;

a fourth transistor having a gate electrode connected to a second electrode of the third transistor, a first electrode connected to an output terminal of an (N−1)-th stage, and a second electrode connected to the Q node of the N-th stage;

a fifth transistor having a gate electrode connected to the compensation node and a first electrode connected to an (N+2)-th clock signal line; and a sixth transistor having a gate electrode connected to a second electrode of the fifth transistor, a first electrode connected to the low-level power line, and a second electrode connected to the output terminal of the N-th stage.

7. The display device of claim 1, wherein the compensation circuit unit outputs the compensation signal when a compensation circuit control signal corresponding to a logic high is output from the sensor circuit unit, and does not output the compensation signal when a compensation circuit control signal corresponding to a logic low is output from the sensor circuit unit.

8. The display device of claim 1, wherein the compensation circuit unit outputs the compensation signal to stabilize a low-level voltage when an on current of transistors of the shift register decreases according to a low-temperature operation.

9. A scan driver, comprising:

a level shifter;

a shift register including a plurality of stages to generate a scan signal on the basis of a signal and power output from the level shifter;

a sensor circuit unit configured to sense internal and external environmental conditions of the shift register and generate a compensation circuit control signal on the basis of a sensed result; and a compensation circuit unit generating a compensation signal to compensate outputs of the plurality of stages in response to the compensation circuit control signal, wherein the compensation circuit unit comprises a first transistor having a gate electrode and a first electrode connected to a first output terminal of the sensor circuit unit, and a second electrode connected to a compensation node of the compensation circuit unit.

10. The scan driver of claim 9, wherein the sensor circuit unit includes one of a temperature sensor for sensing the internal and external environmental conditions, a current sensor for sensing current flowing through a Q node or a QB node of an N-th stage, and a voltage sensor for sensing a voltage of the Q node or the QB node of the N-th stage.

11. The scan driver of claim 9, wherein the compensation circuit unit is configured to stably output a scan signal at a scan high voltage and a scan signal at a scan low voltage through output terminals of the plurality of stages.

12. The scan driver of claim 9, wherein the compensation circuit unit is configured to correspond to circuits for controlling Q nodes or QB nodes of the plurality of stages or composed of a number of transistors less than the number of transistors constituting the circuits for controlling Q nodes or QB nodes.

13. The scan driver of claim 9, wherein the compensation circuit unit further comprises:

a second transistor having a gate electrode connected to the compensation node, a first electrode connected to a low-level power line through which a low-level voltage is provided, and a second electrode connected to the Q node of the N-th stage;

a third transistor having a gate electrode connected to the Q node of the N-th stage, a first electrode connected to the low-level power line, and a second electrode connected to the compensation node; and a fourth transistor having a gate electrode connected to the compensation node, a first electrode connected to the low-level power line, and a second electrode connected to an output terminal of the N-th stage.

14. The scan driver of claim 9, wherein the compensation circuit unit further comprises:

a second transistor having a gate electrode connected to a second output terminal of the sensor circuit unit, a first electrode connected to a low-level power line through which a low-level voltage is provided, and a second electrode connected to the compensation node;

a third transistor having a gate electrode connected to the compensation node and a first electrode connected to an (N−1)-th clock signal line;

a fourth transistor having a gate electrode connected to a second electrode of the third transistor, a first electrode connected to an output terminal of an (N−1)-th stage, and a second electrode connected to the Q node of the N-th stage;

a fifth transistor having a gate electrode connected to the compensation node and a first electrode connected to an (N+2)-th clock signal line; and a sixth transistor having a gate electrode connected to a second electrode of the fifth transistor, a first electrode connected to the low-level power line, and a second electrode connected to the output terminal of the N-th stage.

15. The scan driver of claim 9, wherein the compensation circuit unit outputs the compensation signal when a compensation circuit control signal corresponding to a logic high is output from the sensor circuit unit, and does not output the compensation signal when a compensation circuit control signal corresponding to a logic low is output from the sensor circuit unit.

16. The scan driver of claim 9, wherein the compensation circuit unit outputs the compensation signal to stabilize a low-level voltage when on current of transistors of the shift register decreases according to low-temperature operation.

* * * * *